US005518236A

United States Patent [19]

Morrison

[11] Patent Number: 5,518,236

[45] Date of Patent: May 21, 1996

[54] PINBALL MULTI-PATH PLAY FEATURE WITH MAGNETIC BALL DIVERSION

[75] Inventor: Robert S. Morrison, Elgin, Ill.

[73] Assignee: CAPCOM Coin-Op, Inc., Arlington Heights, Ill.

[21] Appl. No.: 449,692

[22] Filed: May 24, 1995

[51] Int. Cl.[6] ..... A63F 7/30

[52] U.S. Cl. ..... 273/118 A; 273/119 A; 273/121 A; 273/127 R

[58] Field of Search ..... 273/118, 119, 273/121, 127

[56] References Cited

U.S. PATENT DOCUMENTS

| | | | |
|---|---|---|---|
| 4,373,725 | 2/1983 | Ritchie . | |
| 4,542,905 | 9/1985 | Hooker . | |
| 4,981,298 | 1/1991 | Lawlor et al. . | |
| 5,226,653 | 7/1993 | Bil et al. | 273/118 A X |
| 5,358,240 | 10/1994 | Lawlor et al. . | |
| 5,375,829 | 12/1994 | Lawlor et al. . | |
| 5,452,894 | 9/1995 | Hansen | 273/119 A X |

*Primary Examiner*—Raleigh W. Chiu
*Attorney, Agent, or Firm*—Robert E. Browne; Gary R. Jarosik

[57] ABSTRACT

A play feature for use in conjunction with a pinball game having an inclined playfield over which a ball may roll is provided. The play feature includes a ball directing member defining an entrance pathway, a first exit pathway, and a second exit pathway. The entrance pathway is provided to direct the ball along a first predetermined line, the first exit pathway is provided to direct the ball along a second predetermined line, and the second exit pathway provided to direct the ball along a third predetermined line. At least one electromagnet is operatively associated with the ball directing member for causing the ball, upon activation thereof, to alter its course of travel along the first predetermined line to a course of travel along the second predetermined line. Optionally, a second electromagnet may be used for causing the ball, upon activation thereof, to alter its course of travel along the first predetermined line to a course of travel along the third predetermined line. A switch, internal or external, is used to activate the electromagnet. Either one or both of the exit pathways is disposed at an angle relative to the entrance pathway.

12 Claims, 1 Drawing Sheet

PINBALL MULTI-PATH PLAY FEATURE WITH MAGNETIC BALL DIVERSION

BACKGROUND OF THE INVENTION

This invention relates generally to amusement games and, more particularly, relates to a pinball game having a multiple passageway play feature and an electromagnetic ball diverter for directing a pinball into one of the passageways.

Electromagnets have previously been disposed in the playfield of rolling ball games and used to influence the direction of ferromagnetic balls traveling thereover. An example of one such prior art use may be found in U.S. Pat. No. 4,373,725, to Ritchie, directed to a "Pinball Machine Having Magnetic Ball Control". The Ritchie patent discloses an electromagnet located in the playfield and a mechanism manually operable by a player for energizing the electromagnet. The energizing mechanism includes a first switch external to the playfield and operable by a player and a second switch on the playfield which is activated by a ball hitting a target thereon. The first and second switch are connected in series with the electromagnet to control the latter. A timing mechanism is provided to limit the energization of the electromagnet to a predetermined time period. The pinball may approach the electromagnet from any direction and likewise leave the electromagnet in any direction as guides are not provided to direct the pinball thereto or therefrom.

Ball diverters are also known in the art and are typically used above the playfield to direct a pinball to a predetermined location thereon. An example of a prior art ball diverter mechanism may be seen in U.S. Pat. No. 4,981,298, to Lawlor, directed to a "Ball Diverter Playfield Feature For Pinball Machines". The Lawlor patent discloses a mechanical diverter comprising a pair of abutting surfaces disposed on or above the playfield which can be separated to create an alternate ball path. A solenoid controlled, mechanical linkage is used to control the positioning of the surfaces.

While the mechanical ball diverting mechanisms disclosed in the prior art work well in providing a means for altering the predetermined path of the pinball, there exists a need for a ball diverting mechanism which is both novel to the pinball player and cost effective for the pinball manufacturer to install.

As a result of this existing need, it is an object of the present invention to provide an electromagnetic ball diverter mechanism which eliminates the use of the mechanical componentry normally associated therewith, i.e. solenoids and linkage. It is believed that the removal of the mechanical componentry will have the advantage of reducing the cost of manufacture, increasing reliability, and providing a novel means for diverting a pinball for capturing the attention of and entertaining the pinball player.

SUMMARY OF THE INVENTION

In accordance with the present invention, a play feature for use in conjunction with a pinball game having an inclined playfield over which a ball may roll is provided. The play feature includes a ball directing member defining an entrance pathway, a first exit pathway, and a second exit pathway. The entrance pathway is provided to direct the ball along a first predetermined line, the first exit pathway is provided to direct the ball along a second predetermined line, and the second exit pathway provided to direct the ball along a third predetermined line. At least one electromagnet is operatively associated with the ball directing member for causing the ball, upon activation thereof, to alter its course of travel along the first predetermined line to a course of travel along the second predetermined line. Optionally, a second electromagnet may be used for causing the ball, upon activation thereof, to alter its course of travel along the first predetermined line to a course of travel along the third predetermined line. A switch, internal or external, is preferrably used to activate the electromagnet. Either one or both of the exit pathways is disposed at an angle relative to the entrance pathway.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

Figure 1:
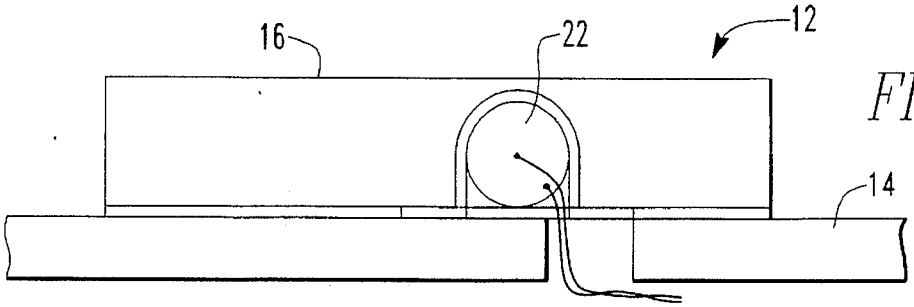
FIG. 1 illustrates a side view of the play feature which is the subject of the present invention.

While the invention can be used in conjunction with any type of amusement game it will be described hereinafter in the context of a pinball machine as the preferred embodiment thereof.

The device which is the subject of the present invention is used in conjunction with a pinball machine comprising a downwardly inclined playfield upon which a pinball rolls. The playfield includes a plurality of target devices which are to be contacted by the rolling pinball. A pair of player operated flippers is typically provided for providing a means for allowing the player to direct the pinball over the playfield at the various targets. The pinball machine may vary widely with respect to the particulars of the scoring as the pinball moves about the playfield and against the targets. Each target, upon being hit by the pinball, either redirects the pinball, adds to the score of the player, or both.

As seen in the Figures, a play feature 12 is shown disposed upon the playfield 14. The play feature 12 generally comprises a ball directing member 16 which defines at least one entrance pathway 18 and at least two exit pathways 20*a*, 20*b*. The ball directing member 16 is constructed so that a ball rolling therein must travel in a predetermined direction. The ball directing member 16 may be constructed of formed plastic or other suitable material having a width slightly greater than the diameter of a standard pinball such that the pinball may travel freely therethrough. While the ball directing member 16 is illustrated as being disposed directly on the playfield 14 it is understood that the ball directing member 16 may also be elevated relative to the playfield 14. Furthermore, while not illustrated, it is desired that a means be provided for transferring a pinball in play from the playfield 14 to the entrance pathway 18 of the play feature 12.

Disposed in proximity to the ball directing member 16 is at least one electromagnet 22. The electromagnet 22 is preferably attached to the playfield 14 or directly to the bail directing member 16 in a position whereby the electromagnet 22 will be able to influence the course of travel of the pinball when activated. The electromagnet 22 is of a conventional design capable of generating a magnetic field of sufficient strength to affect the movement of the pinball passing in the vicinity thereof. An example of an electromagnet capable of imparting such a force is disclosed in the Ritchie reference, U.S. Pat. No. 4,373,625, which patent is incorporated herein by reference in its entirety. The electromagnet 22 may be disposed in a circuit whereby activation of the electromagnet 22 is predicated upon activation of a predetermined target. It is also contemplated than an external, player activatable switch may be utilized to control the electromagnet 22. Furthermore, a timer may be used no control the duration of the activation period of the electromagnet 22 or a switch may a be employed to deactivate the electromagnet 22 after the pinball has passed thereby. As such, it will be appreciated by one skilled in the art that the electromagnet 22 is preferably controlled by a microprocessor which is in turn linked to various targets and/or switches which may be both internal no or external to the playfield 14.

Figure 2:
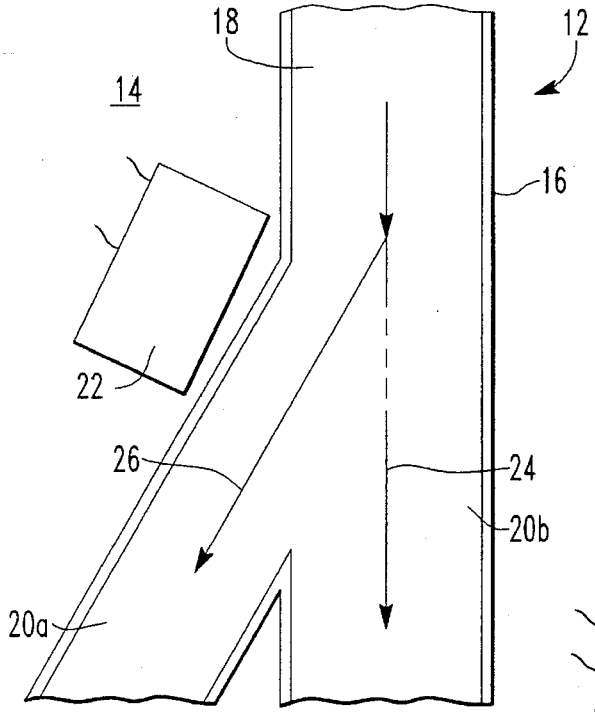
FIG. 2 illustrates an overhead view of one embodiment of the play feature illustrated in FIG. 1.

In a first embodiment, best seen in FIG. 2, a single electromagnet 22 is utilized in conjunction with the ball directing member 16. The ball directing member 16 has its entrance pathway 16 generally aligned with the exit pathway 20*a* along a line 24. The other exit pathway 20*b* has its entrance meeting the exit of the entrance pathway 18 along a line 26 such that the line 26 is disposed at an angle relative to the line 24. Owing to the relationship of the exit pathways 20*a*, 20*b* to the entrance pathway 18, a pinball traveling down the entrance pathway 18 will be predisposed to enter the exit pathway 20*a* and to avoid entering the exit pathway 20*b*. However, the electromagnet 22, which is disposed adjacent to the exit of the entrance pathway 18 on the side of the ball directing member 16 from which the exit pathway 20*b* extends, will, when activated, generate an electromagnetic field which will function to urge the pinball off of it predisposed course of travel along line 24 towards a course of travel along line 26. As such, the electromagnetic force will cause the pinball to enter the exit lane 20*b* and avoid traveling down the exit lane 20*a*.

Figure 3:
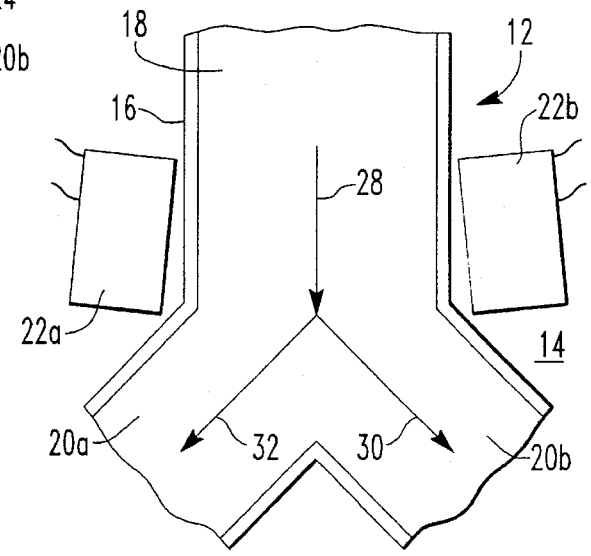
FIG. 3 illustrates an overhead view of a second embodiment of the play feature illustrated in FIG. 1.

In a second embodiment, best seen in FIG. 3, a pair of electromagnets 22*a*, 22*b* are utilized in conjunction with the ball directing member 16. The ball directing member 16 has its entrance pathway 16 generally positioned along a first line 28. The exit pathway 20*a* is generally positioned along a second line 30 while the exit pathway 20*b* is generally positioned along a third line 32. The lines 30, 32 both meet the exit of the entrance ramp 18 at an angle relative to the line 28. Preferably, the entrances of both exit pathways 20*a*, 20*b* meet the exit of the entrance pathway 18 in the same general vicinity thereby creating a "forked" passageway. Owing to the relationship of the exit pathways 20*a*, 20*b* to the entrance pathway 18, a pinball traveling down the entrance pathway 18 will not be predisposed to enter either of the exit pathways 20*a* or 20*b* such that the course of further travel by the pinball into either of the exit pathways 20*a*, 20*b* is randomly determined. However, the electromagnet 22*a*, which is disposed adjacent to the exit of the entrance pathway 18 on the side of the ball directing member 16 from which the exit pathway 20*a* extends, will, when activated, generate an electromagnetic field which will function to urge the pinball towards a course of travel along line 30. As such, the electromagnetic force will cause the pinball to enter the exit lane 20*a* and avoid traveling down the exit lane 20*b* whereby the random course of travel of the pinball may be eliminated. Similarly, the electromagnet 22*b*, which is disposed adjacent to the exit of the entrance pathway 18 on the side of the ball directing member 16 from which the exit pathway 20*b* extends, will, when activated, generate an electromagnetic field which will function to urge the pinball towards a course of travel along line 32. As such, the electromagnetic force will cause the pinball to enter the exit lane 20*b* and avoid traveling down the exit lane 20*a* whereby the random course of travel of the pinball may be eliminated. It is preferably that only one electromagnet 22*a*, 22*b* be capable of being operated at any one time.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed:

1. A pinball machine, comprising:

an inclined playfield over which a ball may roll;

a ball directing connected to said playfield defining an entrance pathway, a first exit pathway, and a second exit pathway, said entrance pathway provided to direct said ball along a first predetermined line, said first exit pathway provided to direct said ball along a second predetermined line, and said second exit pathway provided to direct said ball along a third predetermined line;

a electromagnet disposed adjacent to said ball directing member for causing said ball, upon activation thereof, to alter its course of travel along said first predetermined line to a course of travel along said second predetermined line; and a microprocessor for controlling activation of said electromagnet;

wherein said second predetermined line is disposed at an angle relative to said first predetermine line and said third predetermined line is substantially aligned with said first predetermined line such that said ball will take a course of travel along said third predetermined line if said electromagnet is not activated.

2. The pinball machine as recited in claim 1, wherein said ball directing member is elevated above said playfield and said electromagnet is mounted to said ball directing member.

3. The pinball machine as recited in claim 2, further comprising means for moving said ball to said entrance pathway.

4. A pinball machine, comprising:

an inclined playfield over which a ball may roll;

a ball directing connected to said playfield defining an entrance pathway, a first exit pathway, and a second exit pathway, said entrance pathway provided to direct said ball along a first predetermined line, said first exit pathway provided to direct said ball along a second predetermined line, and said second exit pathway provided to direct said ball along a third predetermined line;

a first electromagnet disposed adjacent to said ball directing member for causing said ball, upon activation thereof, to alter its course of travel along said first predetermined line to a course of travel along said second predetermined line;

a second electromagnet operatively associated with said ball directing member for causing said ball, upon activation thereof, to alter its course of travel along said first predetermined line to a course of travel along said third predetermined line; and a microprocessor for controlling activation of said first and second electromagnets;

wherein said second and third predetermined lines are disposed at an angle relative to said first predetermine line.

5. The play feature as recited in claim 4, wherein the activation of said first and second electromagnets is mutually exclusive.

6. The play feature as recited in claim 5, wherein said first, second, and third predetermined lines intersect at a common location.

7. A play feature for use in conjunction with a pinball game having an inclined playfield over which a ball may roll, comprising:

a ball directing member defining an entrance pathway, a first exit pathway, and a second exit pathway, said entrance pathway provided to direct said ball along a first predetermined line, said first exit pathway provided to direct said ball along a second predetermined line, and said second exit pathway provided to direct said ball along a third predetermined line;

a first electromagnet operatively associated with said ball directing member for causing said ball, upon activation thereof, to alter its course of travel along said first predetermined line to a course of travel along said second predetermined line; and switch means for controlling activation of said first electromagnet.

8. The play feature as recited in claim 1, wherein said second predetermined line is disposed at an angle relative to said first predetermine line.

9. The play feature as recited in claim 8, wherein said third predetermined line is substantially aligned with said first predetermined line such that said ball will take a course of travel along said third predetermined line if said first electromagnet is not activated.

10. The play feature as recited in claim 8 further comprising a second electromagnet disposed adjacent to said ball directing member the activation of which is controlled by said switch means and wherein said ball will be caused to travel along said third predetermined line when said second electromagnet is activated.

11. The play feature as recited in claim 10, wherein said third predetermined line is disposed at an angle relative to said first predetermined line.

12. The play feature as recited in claim 11, wherein the activation of said first and second electromagnets is mutually exclusive.

* * * * *